US005579018A

United States Patent [19]

Francis et al.

[11] Patent Number: 5,579,018

[45] Date of Patent: Nov. 26, 1996

[54] REDUNDANT DIFFERENTIAL LINEAR ACTUATOR

[75] Inventors: Colin M. Francis, Redwood Shores; Christopher M. Balkenhol; Carolyn S. Balkenhol, both of San Mateo, all of Calif.

[73] Assignee: Space Systems/Loral, Inc., Palo Alto, Calif.

[21] Appl. No.: 435,401

[22] Filed: May 11, 1995

[51] Int. Cl.[6] ..... H01Q 3/00

[52] U.S. Cl. ..... 343/757; 343/761; 343/765; 343/766; 343/878

[58] Field of Search ..... 343/757, 758, 343/761, 765, 776, 878, 880, 882, 766, DIG. 2; 248/184, 371, 396

[56] References Cited

U.S. PATENT DOCUMENTS

| | | | |
|---|---|---|---|
| 2,907,031 | 9/1959 | Meredith | 343/757 |
| 3,215,391 | 11/1965 | Storm | 248/396 |
| 3,286,266 | 11/1966 | Barnes | 343/882 |
| 3,407,404 | 10/1968 | Cook et al. | 343/765 |
| 3,658,286 | 4/1972 | Terai et al. | 248/371 |
| 4,095,770 | 6/1978 | Long | 248/371 |
| 4,197,548 | 4/1980 | Smith et al. | 343/765 |
| 4,360,182 | 11/1982 | Titus | 248/371 |
| 4,475,110 | 10/1984 | Hutchins | 343/882 X |
| 4,582,291 | 4/1986 | Matthews | 343/765 X |
| 4,647,939 | 3/1987 | Kolhoff | 343/765 |
| 4,848,179 | 7/1989 | Ubhayakar | 74/479 |

*Primary Examiner*—Donald T. Hajec
*Assistant Examiner*—Tho Phan
*Attorney, Agent, or Firm*—Perman & Green

[57] ABSTRACT

A positioning device orients an antenna element, or an entire antenna of multiple elements, or other payload requiring positioning relative to a supporting base. The antenna element is pivotally mounted upon the base, and a strut extends from the antenna element to an actuator assembly which moves the strut to adjust the orientation of the antenna element. The actuator assembly has two linear actuators which extend from the base, respectively, to opposite ends of a lever which, in turn, connects via a pivot to an end of the strut distant from the antenna element. The lever pivot is located between the ends of the lever at a location closer to one of the ends than to the other of the ends of the lever, such as a two-to-one ratio of lever arm lengths. Use of a first of the actuators by itself serves for the primary source of adjustment of the position of the antenna element. The second actuator provides a backup or redundant mode of the adjustment, and also serves to extend the range of adjustment from that which can be accomplished alone by the first actuator. Each actuator provides linear motion, and may include components such as an electric stepping motor allowing for electronic control of the adjustment in stepwise fashion with fine step control.

11 Claims, 7 Drawing Sheets

REDUNDANT DIFFERENTIAL LINEAR ACTUATOR

BACKGROUND OF THE INVENTION

This invention relates to linear actuators suitable for positioning a payload, such as an antenna element for accurate orientation of a beam of radiation provided by the antenna and, more particularly, to a set of differentially coupled linear actuators connected to an antenna mount wherein a second of the actuators can act in concert or as a backup to the primary actuator.

Antennas used in communication systems, particularly satellite communication systems, must be accurately positioned to insure that a narrow pencil beam is oriented in a desired direction. In a multi-element antenna, such as an antenna employing both a main antenna and a subreflector which illuminates the main antenna with radiation from a feed, adjustment of the orientation of the subreflector itself can refine the beam definition as well as the beam orientation. The general direction of the beam can be established in the construction of the satellite wherein the antenna is given a specific orientation relative to the satellite and, then, upon placing the satellite into orbit, refinements in the position of the satellite serve to direct the antenna accurately in a desired direction. Further adjustment of a beam shape and direction can be accomplished electronically in the case of phased array antenna. However, it may still be advantageous to provide for mechanical adjustment of the antenna position, or orientation of an element of the antenna, particularly if the antenna feed and possibly reflectors of the antenna have been configured to provide a specific configuration of beam.

Mechanical scanners of antennas have been used for many years to provide for scans such as an azimuthal scan. Such scanners are generally large and heavy which would militate against their use in a satellite and, furthermore, may not be suitable to provide the very fine adjustment in orientation of an antenna or an element thereof as is required for a satellite borne antenna. A further requirement for satellite operation is reliability such as may be afforded by a positioning system employing redundant positioning devices. A problem arises in that presently available positioning apparatus does not offer the function of very fine accuracy over a moderate range of scan angle in combination with the features of small size and weight in conjunction with redundancy, especially mechanical redundancy.

SUMMARY OF THE INVENTION

The aforementioned problem is overcome and other advantages are provided by positioning apparatus which, in accordance with the invention, operates to position a payload, such as an antenna element, or an antenna of multiple elements, relative to a supporting base. To facilitate the description, the invention will be described with reference to an antenna element, it being understood that the principles of operation of the invention apply also to the positioning of an entire antenna, or other payloads, such as telescopes, cameras, and sensors, by way of example.

The antenna element is pivotally mounted upon the base, and a strut extends from the antenna element to an actuator assembly which moves the strut to adjust the orientation of the antenna element. The actuator assembly comprises two linear actuators which extend from the base, respectively, to opposite ends of a lever which, in turn, connects via a pivot to an end of the strut distant from the antenna pivot. The lever pivot is located between the ends of the lever at a location closer to one end than the other.

In a preferred embodiment of the invention, the primary actuator is positioned from the lever pivot by a distance equal to twice the distance from the lever pivot to the second of the actuators. Use of the first actuator by itself serves for the primary source of adjustment of the position of the antenna element. The second actuator provides a backup or redundant mode of the adjustment. In this arrangement, in the event of a failure of the primary actuator anywhere within its range of motion, the secondary actuator can adjust the antenna position to be anywhere within the primary actuator's original range of motion, this providing mechanical redundancy and the capacity to recover from mechanical failures. In addition, the second actuator serves to extend the range of adjustment from that which can be accomplished by the first actuator. Each actuator includes an electric stepping motor allowing for electronic control of the adjustment in stepwise fashion with fine step control.

BRIEF DESCRIPTION OF THE DRAWING

The aforementioned aspects and other features of the invention are explained in the following description, taken in connection with the accompanying drawing figures wherein.

Identically labeled elements appearing in different ones of the figures refer to the same element in the different figures.

DETAILED DESCRIPTION

Figure 1:
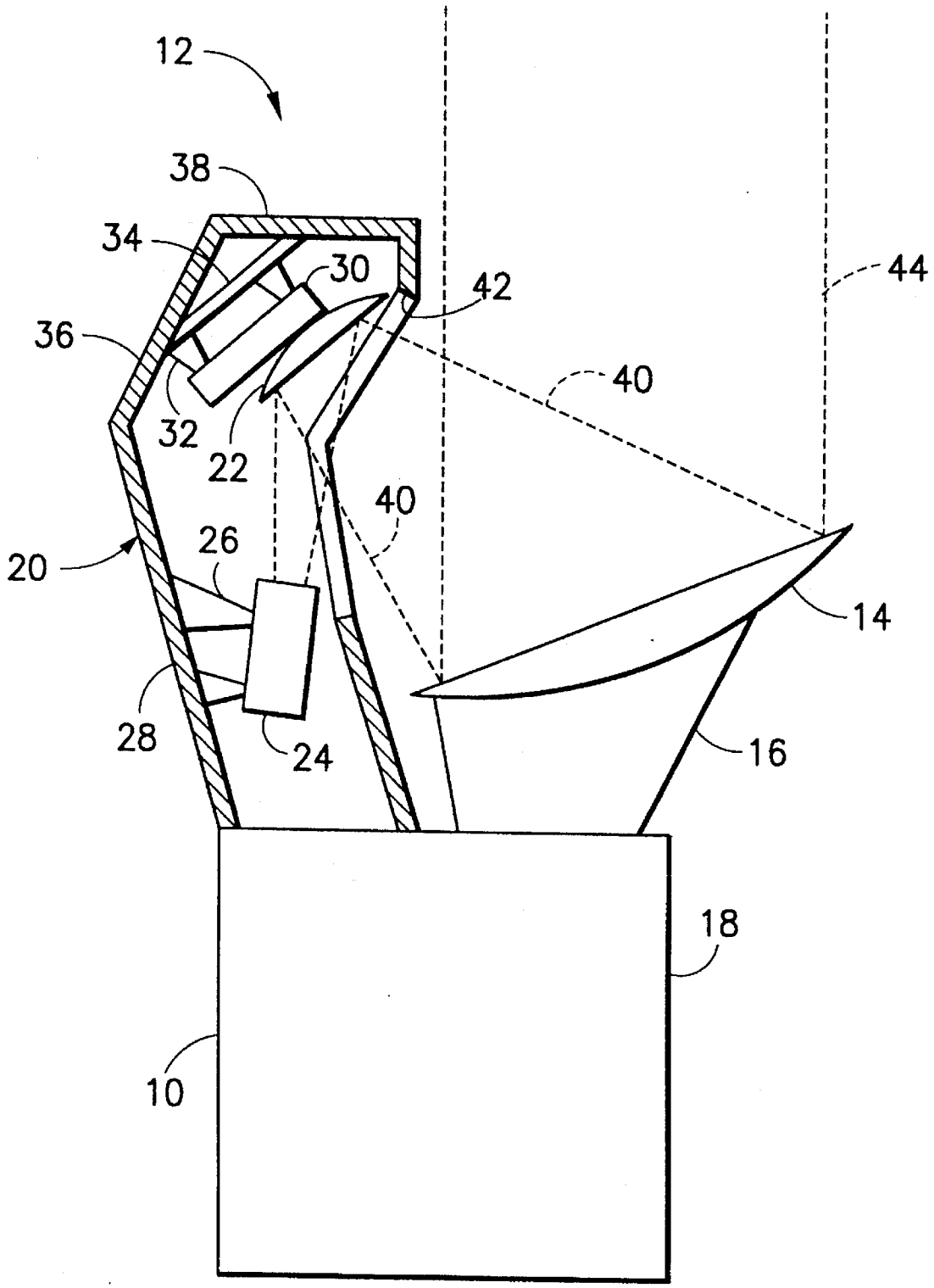
FIG. 1 shows a stylized view of a satellite borne antenna having a subreflector positioned by a positioning device constructed in accordance with the invention, a support having the shape of a tower for locating the subreflector and the positioning device and a feed relative to a main reflector of the antenna being sectioned for showing the subreflector and the positioning device and the feed.

With reference to FIG. 1, a satellite 10 carries an antenna 12 having a main reflector 14 secured by a mount 16 to a body 18 of the satellite 10. A supporting structure, to be referred to as a tower 20, extends from the body 18 for positioning a subreflector 22 and a feed 24 of the antenna 12 relative to the main reflector 14. By way of example, the feed 24 may be secured by stanchions 26 to a sidewall 28 of the tower 20. The subreflector 22 is supported, in accordance with the invention, by a positioning device 30, the device 30 being secured by stanchions 32 to a supporting arm 34 which extends between frame elements 36 and 38 of the tower 20. In a transmission mode of the antenna 12, radiant signals from the feed 24 are directed to the subreflector 22 which reflects the signals via rays 40 through a port 42 of the tower 20 to impinge upon the main reflector 14 for formation of an output beam 44. In a reception mode of the antenna 12, incoming signals arrive via the beam 44, and are reflected by the main reflector 14 and by the subreflector 22 to the feed 24.

The direction of the beam 44 relative to the body 18, and the cross-sectional shape of the beam 44 are dependent on the orientation of the subreflector 22 relative to the main reflector 14. While the basic orientation of the subreflector 22 relative to the main reflector 14 is provided by the tower 20 and the mount 16, fine adjustment of the orientation is to be provided, in accordance with the invention, by operation of the positioning device 30 in positioning the subreflector 22. By way of example, the antenna 12 may be used as part of a satellite communication system, in which case accurate positioning of the beam 44 is important for illuminating a desired portion of the earth's surface.

Figure 2:
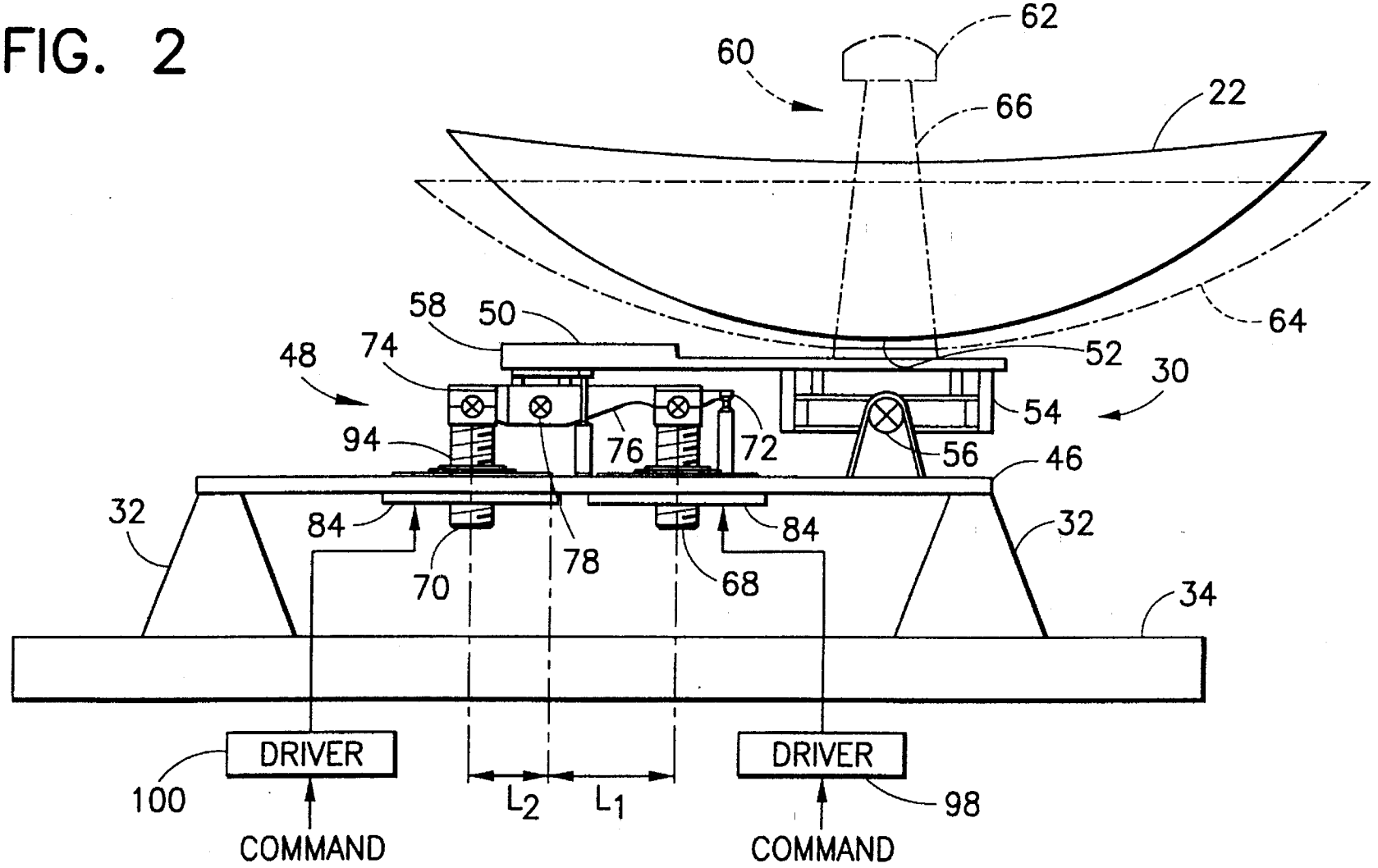
FIG. 2 is a side elevational view, partially diagrammatic, of the positioning device of FIG. 1 with electrical control thereof being indicated in block diagrammatic form for positioning an antenna element such as the subreflector of FIG. 1, and wherein FIG. 2 also demonstrates an alternative use of the positioning device for positioning an entire antenna shown in phantom.

As shown in FIG. 2, the positioning device 30 comprises a base 46, an actuator assembly 48 supported by the base 46, and a strut 50 connecting between the actuator assembly 48 and a central part 52 of the back side of the subreflector 22. A frame assembly 54 secures the central part 52 of the subreflector 22 to a pivot 56, the pivot 56 being mounted to the base 46. The base 46 is connected by the stanchions 32 to the arm 34. The actuator assembly 48 is operative to move an end 58 of the strut 50 relative to the base 46. The end 58 is distant from the subreflector 22 so that, upon a displacement of the end 58 relative to the base 46, there is a pivoting of the strut 50 with a corresponding pivoting or rotation of the subreflector 22 about the pivot 56. Thereby, the actuator assembly 48 is able to adjust the orientation of the subreflector 22 relative to the base 46, and via connection of the base 46 to the support 34 of the tower 20, the orientation of the subreflector 22 is adjusted relative to the main reflector 14 of FIG. 1.

It is noted that, in accordance with the invention, the positioning device 30 may be used, not only for positioning an element of an antenna such as the foregoing subreflector 22, but may be used also for positioning an entire antenna such as an antenna 60 indicated in phantom view in FIG. 2. By way of example, the antenna 60 may comprise a feed 62 and a reflecting dish 64, wherein the feed 62 is positioned by a stalk 66 in front of the dish 64. Connection of the positioning device 30 to the antenna 60 is made in a fashion analogous to the connection of the positioning device 30 to the subreflector 22.

The actuator assembly 48 comprises a primary linear actuator 68 and a secondary, or backup, linear actuator 70 upstanding from the base 46 to connect pivotally with first and second ends 72 and 74, respectively, of a lever 76. A pivot 78 is located on the lever 76 between the lever ends 72 and 74, and makes pivotal contact between the lever 76 and the end 58 of the strut 50. The distance L1 between an axis of the primary actuator 68 and the pivot 78 is greater than the distance L2 between an axis of the secondary actuator 70 and the pivot 78, a ratio of L1/L2 equal to 2 being employed in a preferred embodiment of the invention.

The enlarging of the distance L1 relative to the distance L2 permits the primary actuator 68 to provide for a finer incremental movement of the subreflector 22 than can be accomplished by the secondary actuator 70. The two actuators acting together can provide for a larger range of movement of the subreflector 22 than can be accomplished by the primary actuator 68 acting alone. In particular, the secondary actuator 70 may be employed to establish a coarse position of the subreflector 22 with a fine adjustment of the position of the subreflector 22 being provided by the primary actuator 68. Also, repositioning of the secondary actuator 70 may be employed to avoid generation of a wear spot on either of the pivotal connections of the actuators 68 and 70 to the lever 76 or to the actuators 68 and 70.

Backup operation of the secondary actuator 70 is available in the event that the primary actuator 68 fails, in which event positioning of the subreflector 22 can still be accomplished but with coarser steps of adjustment than can be accomplished by use of the primary actuator 68.

Each of the actuators 68 and 70 provides linear motion and, in this example, includes an electric stepping motor 84 for operating a ballscrew drive 86 (shown in FIG. 4) having a nut 88 and a screw 90. Activation of the motor 84 results in rotation of the nut 88 to advance the screw 90 along an axis 92 of the actuator 68 or 70. The screw 90 is enclosed by a bellows 94 shown in both FIGS. 2 and 4. As shown on FIG. 2, the actuators 68 and 70 are activated by drivers 98 and 100 providing output signals to the motors 84 of the actuators 68 and 70, respectively. The drivers 98 and 100 comprise well known electric circuits for generating electric pulse signals for driving the motors 84 in response to digital commands input to the drivers 98 and 100. Other devices such as linear motors and piezoelectric positioners, by way of example, can also be used to fulfill the actuator function.

Upon operation of the primary actuator 68 alone while the secondary actuator 70 is stationary, the end 58 of the strut 50 advances by a displacement equal to only one-third of the displacement of the screw 90 (FIG. 4) of the actuator 68 in view of the 2:1 relationship in the lengths of the distances L1 and L2. However, upon activation of the secondary actuator 70 alone, while the primary actuator 68 is stationary, the end 58 of the strut 50 advances by a displacement which is equal to two-thirds of the displacement of the screw 90 of the secondary actuator 70.

Figure 3A:
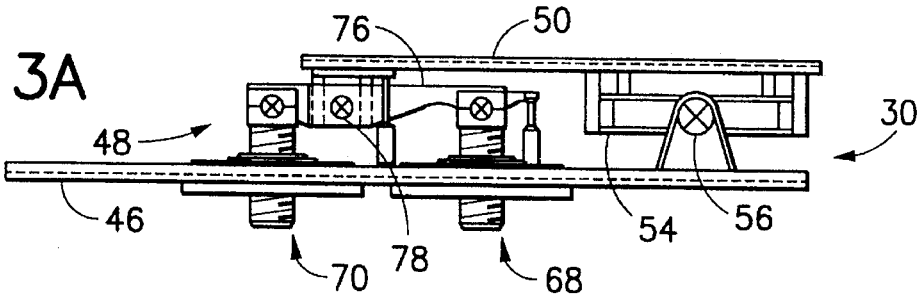
FIGS. 3A–3E show a sequence of different attitudes of the positioning device of FIG. 2 to accomplish different orientations of the subreflector of FIG. 1.
Figure 3B:
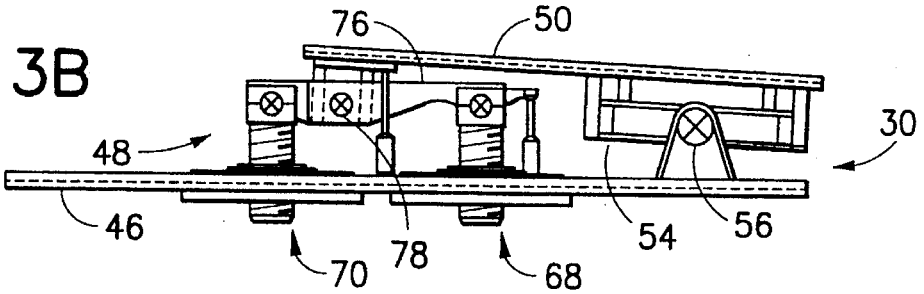
Figure 3C:
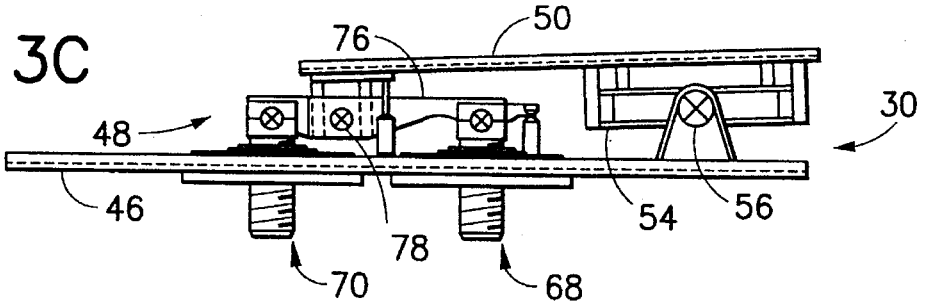
Figure 3D:
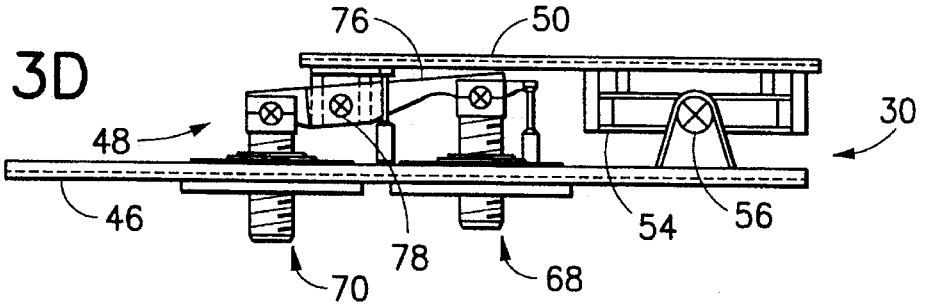
Figure 3E:
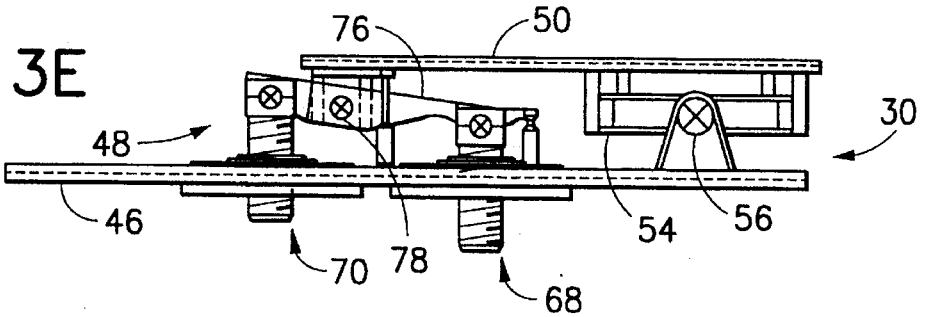

FIGS. 3A–3E show a series of views of the positioning device 30 wherein, in each of the views, there is a different set of orientations among the strut 50, the lever 76, and the base 46. The different orientations occur by virtue of the positions of the actuators 68 and 70 relative to each other and to the base 46, via the pivoting of the strut 50 with the frame 54 relative to the base 46 via the pivot 56, and via the pivoting of the strut 50 relative to the lever 76 about the pivot 78 in the actuator assembly 48. It is recognized that the showing of the positioning device 30 in FIGS. 3A–3E is similar to that shown in FIG. 2, but wherein the subreflector 22 has been deleted in FIGS. 3A–3E to simplify the drawing. In FIG. 3A, both of the actuators 68 and 70 are shown at essentially equal positions, their positions providing for a substantially parallel relationship between the strut 50 and the base 46. In FIG. 3B, both of actuators 68 and 70 are in a raised position resulting in a tilting of the strut 50 in the clockwise direction about the pivot 56. In FIGS. 3C, both of the actuators 68 and 70 are depressed resulting in a pivoting of the strut 50 in a counterclockwise direction about the pivot 56. In FIG. 3D, the strut 50 is tilted slightly in the counterclockwise direction but by action of the actuator assembly 48 wherein the primary actuator 68 is displaced in the upward direction and the secondary actuator 70 is depressed. In FIG. 3E, the strut 50 is pivoted slightly in the clockwise direction about the pivot 56 but by operation of the actuator assembly 48 wherein the primary actuator 68 is depressed and the secondary actuator 70 is advanced above the base 46. The FIGS. 3A–3E demonstrate how different configurations of the actuators within the actuator assembly 48 produce various orientations of the strut 50, this corresponding with the storage of the various orientations in the memory 104 of FIG. 2.

Figure 4:
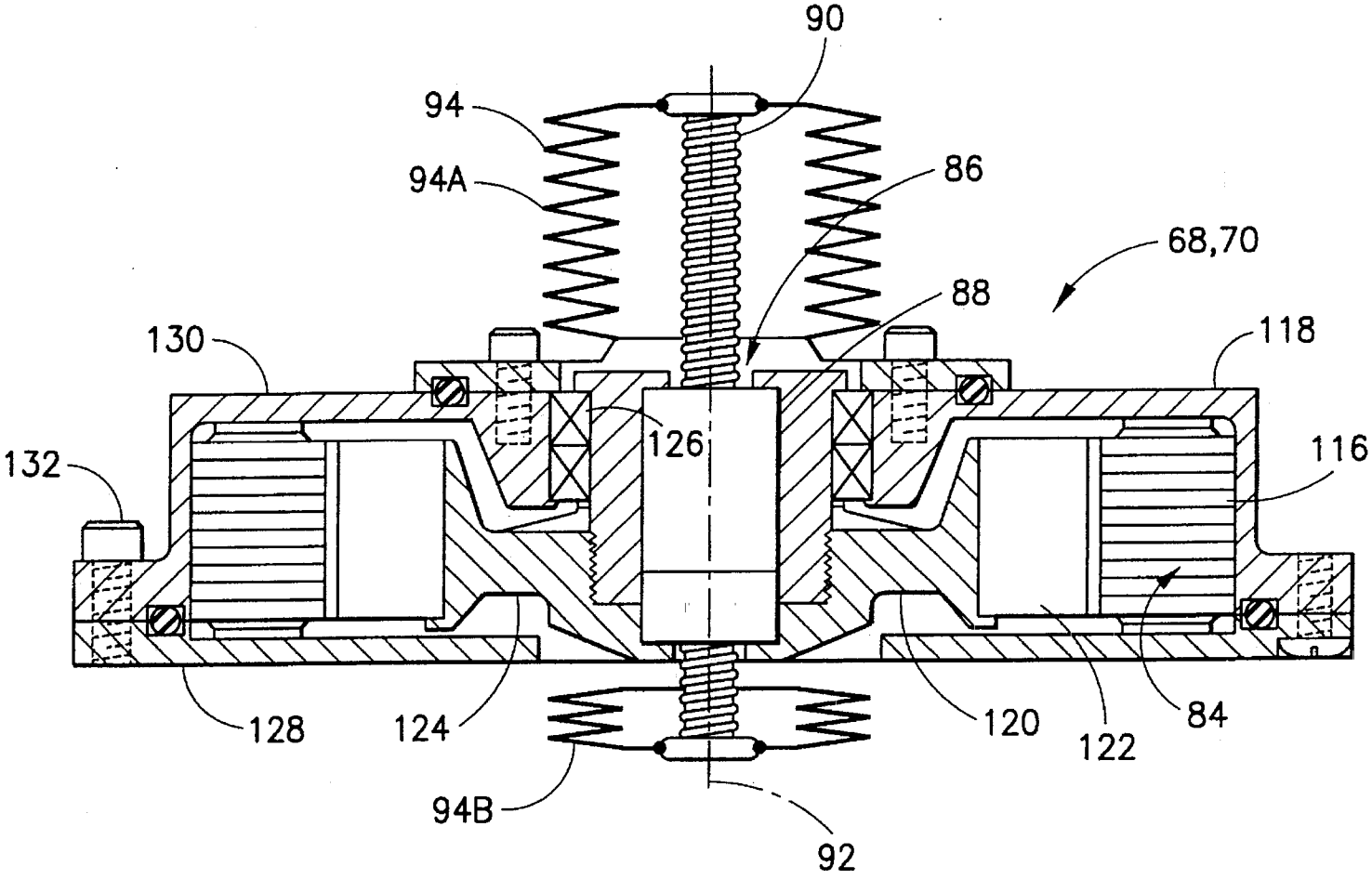
FIG. 4 is a sectional view of one of two actuators of the positioning device.

With reference to FIG. 4, in a preferred embodiment of the invention, the two actuators 68 and 70 are identical in their construction and, accordingly, FIG. 4 shows the construction of either one of the actuators 68 and 70. To facilitate the ensuing description, reference will be made to the actuator 68, it being understood that the description applies equally to the actuator 70. In the operation of the actuator 68, the aforementioned rotation of the nut 88 by the motor 84 results in a displacement of the screw 90 either in an upward direction or a downward direction, relative to the view of FIG. 4, depending on the rotation of the nut 88. A portion of the bellows 94 of the ball screw drive 86 extends above the motor 84 and is identified as the bellows portion 94A while a further portion 94B extends below the motor 84 for enclosing the lower portion of the screw 90. The function of the bellows is to prevent rotation of the screw and to prevent lubricant loss and contamination of the actuator. The motor 84 includes a stator winding 116 secured within a housing 118, and a rotor 120 having magnetic pole pieces 122 carried by an outer portion of a disk 124 of the rotor 120, and inner portions of the disk 124 connecting with the nut 88. The rotor 120 is rotatably mounted within the housing 118 by bearings 126. The housing 118 includes a back plate 128 which is secured to a body 130 of the housing 118 via bolts 132 (one of which is shown). Electric drive signals provided by the driver 98 or 100 (FIG. 2) are applied to the stator winding 116 for activating the motor 84 to rotate the rotor 120 to a desired position of rotation about the axis 92. Thereby, the actuator 68 and/or 70 responds to the output signals of the computer 96 (FIG. 2) for operating the actuator assembly 48 to orient the subreflector 22.

Figure 5:
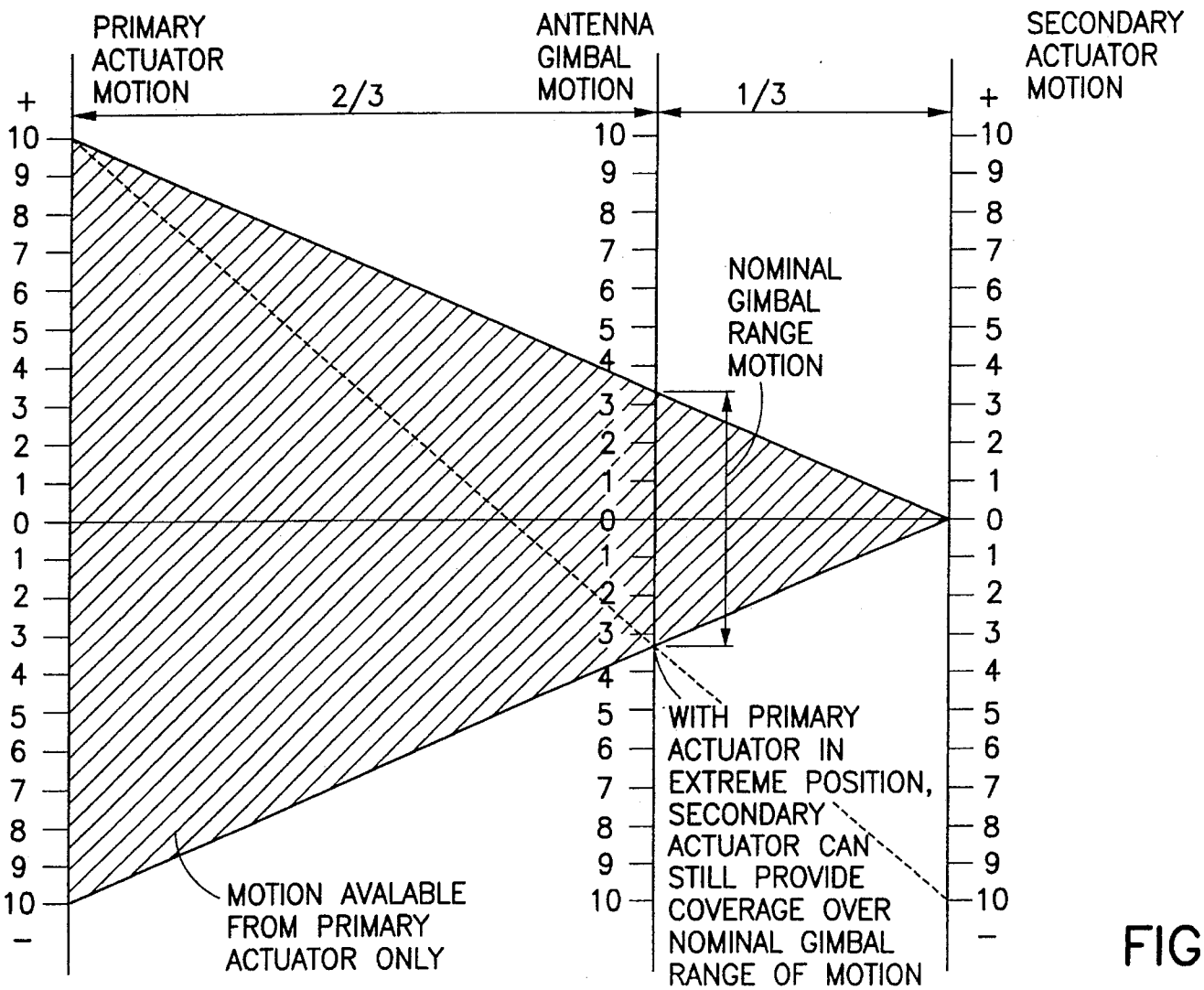
FIGS. 5 and 6 are charts useful in explaining operation of an actuator assembly of the positioning device of FIGS. 1 and 2.
Figure 6:
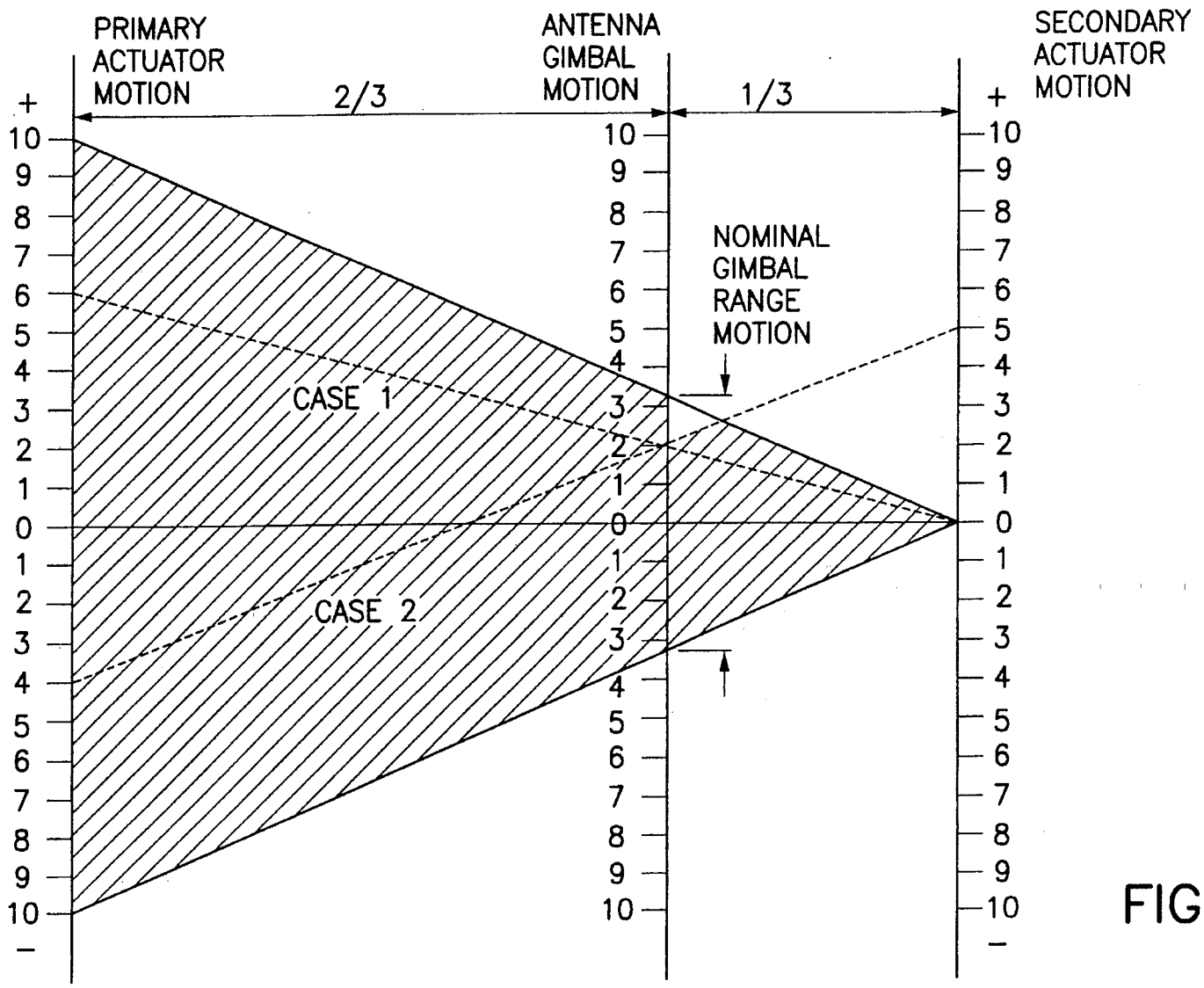

FIGS. 5 and 6 are charts showing ranges of positions of the primary and the secondary actuators 68 and 70 (FIGS. 2 and 3A–3E) and the resultant range of positions of the pivot 78 serving as the antenna gimbal. The positions of the actuators 68 and 70 correspond to commands applied to the drivers 100 and 98, respectively, for operating the actuators 68 and 70 to attain a desired position of a load, such as the antenna reflector 22 (FIG. 1). In terms of the practice of the invention, any suitable source of such commands may be employed, whether the commands be developed manually, or automatically as by a computer (not shown). Both of the charts show a nominal value of gimbal position at zero with excursions of both positive and negative values being indicated over a nominal gimbal range of motion. Movement of the primary actuator over a range from −10 to +10 units of movement provides movement of the gimbal over the nominal range even with the secondary actuator fixed in position at 0. As shown in FIG. 5, even if the primary actuator fails and is locked in an extreme position of +10, the secondary actuator can provide movement of the gimbal over its nominal range. This is indicated in the example in FIG. 5 wherein a secondary actuator position of −10 compensates for the locked position of +10 of the failed primary actuator. In the geometric construction of the graphs of FIGS. 5 and 6, the vertical line representing the gimbal position is spaced apart from the primary actuator by ⅔ of the spacing between the actuators, this being the same relationship for the location of the gimbal relative to the actuators as depicted in FIGS. 2 and 3A–3E.

FIG. 6 provides two further examples, identified as Case 1 and Case 2. With the secondary actuator at 0, the primary actuator is located at the position +6 to maintain the gimbal at the position +2, as shown in Case 1. If it is desired to operate the primary actuator at a different location (possibly for reasons of minimizing wear), such as the position of −4 in Case 2, then the secondary actuator is moved to the position +5 to maintain the gimbal at the position of +2. By setting the location of one actuator, and knowing the desired location of the gimbal, the location of the other actuator can be determined from the chart by extending a line between the known locations. It is noted that components of the actuator assembly 48 (FIGS. 2 and 3A–3E) follow arcs about their pivot points. Therefore, the foregoing straight line calculation is an approximation of the outputted position of the actuator assembly at the gimbal, the approximation providing adequate accuracy over relative small angles, such as a few degrees.

Figure 7:
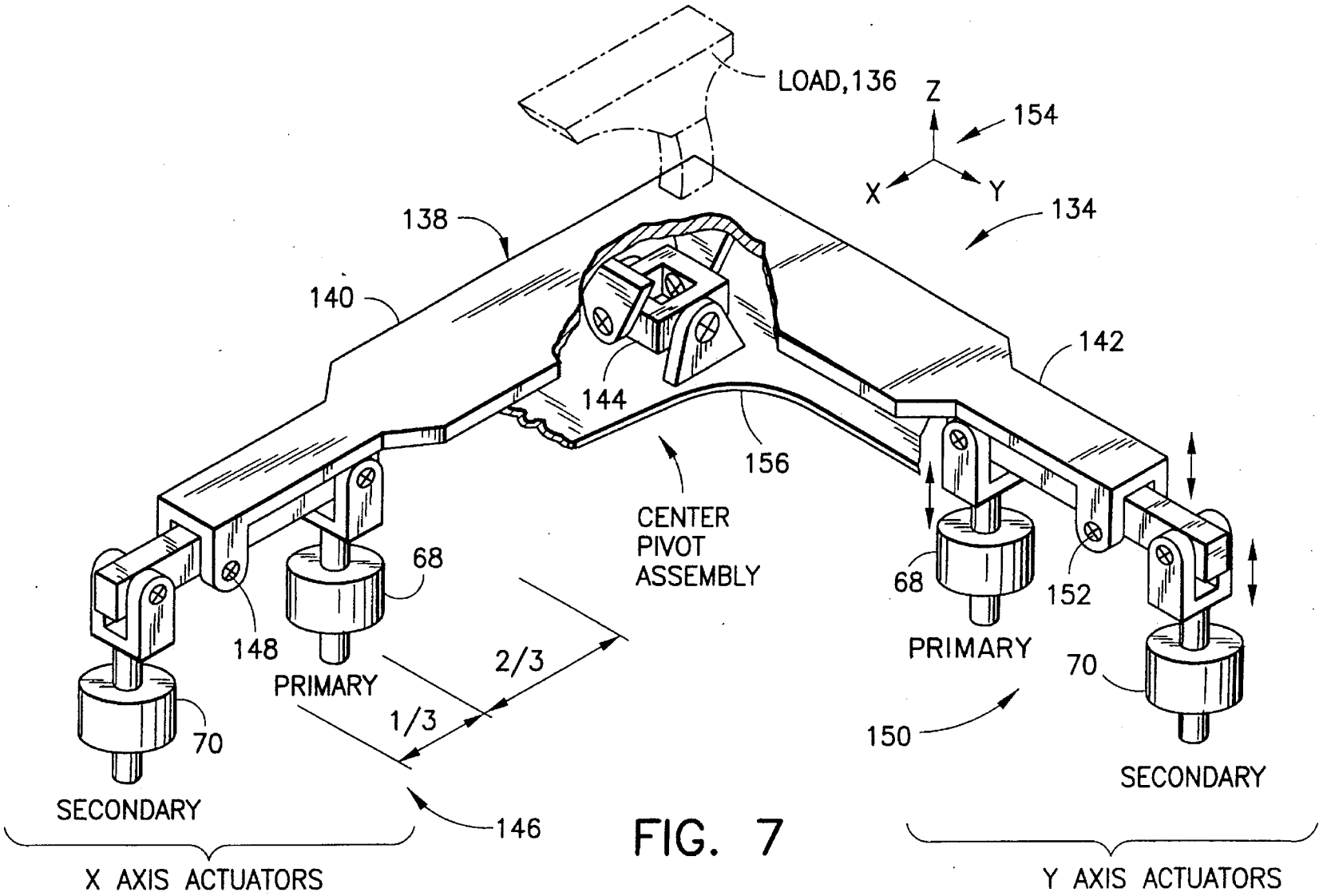
FIG. 7 is a simplified isometric view of an embodiment of the invention wherein the positioning device is constructed as a redundant differential linear actuator assembly having a two-axes mechanical configuration.

FIG. 7 shows a two-axes positioning system 134 for position a load 136, indicated in phantom. The load 136 may be an antenna reflector, telescope, or laser, by way of example. In accordance with this embodiment of the invention, the system 134 comprises a mount 138 having a first arm 140 and a second arm 142 which is perpendicular to the first arm 140, and meets the first arm 140 at a universal pivot 144. The pivot 144 enables the mount 138 to pivot in two orthogonal directions, namely, the x direction and the y direction. The load 136 is supported by the mount 138 at the location of the pivot 144. The first arm 140 extends along the x axis and the second arm 142 extends along the y axis.

The positioning system 134 further comprises a first actuator assembly 146 pivotally connected by a pivot or gimbal 148 to the first arm 140, and a second actuator assembly 150 pivotally connected by a pivot or gimbal 152 to the second arm 142. Each of the actuator assemblies 146 and 150 is constructed in the form of the actuator assembly 48 (FIGS. 2 and 3A–3E), and includes the primary actuator 68 and the secondary actuator 70. In each of the actuator assemblies 146 and 150, and with respect to the spacing between the actuators 68 and 70, the gimbals 148 and 152, respectively, are located at a distance of ⅔ of the actuator spacing from the respective primary actuators 68. This locating of the gimbals is shown in FIG. 7 for the gimbal 148. The two actuator assemblies 146 and 150 are operable independently of each other, each being operable in the same fashion as described above for the actuator assembly 48. With reference to the xyz coordinate system 154, the actuator assembly 146 serves to pivot the mount 138 and the load 136 about the y axis by movement of the first arm 140 in the xz plane while the actuator assembly 150 serves to pivot the mount 138 and the load 136 about the x axis by movement of the second arm 142 in the yz plane. The pivot 144 and the actuators 68 and 70 of the actuator assemblies 146 and 150 rest upon a common support 156, partially shown in FIG. 7. The support 156 provides the function of the base 46, described hereinabove in FIGS. 2 and 3A–3E. Thereby, the two-axes positioning system 134 is operative to position the load 136 about two mutually perpendicular axes.

It is to be understood that the above described embodiment of the invention is illustrative only, and that modifications thereof may occur to those skilled in the art. Accordingly, this invention is not to be regarded as limited to the embodiment disclosed herein, but is to be limited only as defined by the appended claims.

What is claimed is:

1. A load positioning device comprising:

a lever having a first end, and a second end opposite said first end;

a support, and a pivot interconnecting said lever with a load, said pivot being located on said lever colinearly with and between said first end and said second end, said pivot being located closer to said second end of said lever than to said first end of said lever;

a first actuator connected between said first end of said lever and said support and being operative to adjust a first spacing between said first end of said lever and said support, said first actuator having a first telescoping length equal to said first spacing;

a second actuator connected between said second end of said lever and said support and being operative to adjust a second spacing between said second end of said lever and said support, said second actuator having a second telescoping length equal to said second spacing;

wherein a spacing of said pivot from said support is intermediate said first actuator length and said second actuator length; and operation of either of said actuators serves to adjust an orientation of said load relative to said support.

2. A positioning device according to claim 1 wherein said load is an antenna reflector.

3. A positioning device according to claim 1 wherein said load is a subreflector of an antenna which further comprises a feed and a primary reflector, and operation of either of said actuators serves to orient said subreflector to provide for a direction of rays of radiation between said feed and said primary reflector via said subreflector.

4. A positioning device according to claim 1 wherein said load is an antenna reflector, said positioning device further comprising a strut extending from said pivot to said reflector and being secured rigidly to said reflector, and wherein said reflector is pivotally mounted to said support allowing orientation of said strut and said reflector to be established by operation of either of said actuators.

5. A positioning device according to claim 4 wherein said first actuator serves as a primary actuator to accomplish a fine positioning of said reflector, and said second actuator serves as a backup actuator providing for a coarse positioning of said reflector.

6. A positioning device according to claim 5 wherein each of said actuators has a lever attachment point for attachment to said lever, and said actuators input linear motion to their respective lever attachment points.

7. A positioning device according to claim 6 wherein each of said actuators comprises a drive including a stepping motor which provides stepwise increments in position of said lever upon activation of the actuator.

8. A positioning device according to claim 7 wherein the motor is an electric device capable of providing controlled angular motion.

9. A load positioning device comprising:

a mount for supporting a load, said mount comprising a universal pivot with a first arm and a second arm extending in perpendicular directions from said universal pivot, said universal pivot providing for a pivoting action in two orthogonal directions, each of said arms having a first end at said universal pivot and a second end opposite said first end;

a first actuator assembly connecting with the second end of said first arm and a second actuator assembly connecting with the second end of said second arm, each of said actuator assemblies comprising a lever having a first end and a second end opposite said first end;

a support for supporting both of said actuator assemblies;

wherein, in each of said actuator assemblies, there is a pivot interconnecting said lever with a respective one of said arms, said pivot being located on said lever between said first end and said second end of said lever;

wherein each of said actuator assemblies further comprises a first actuator connected between said first end of said lever and said support and being operative to adjust a spacing between said first end of said lever and said support;

each of said actuator assemblies further comprises a second actuator connected between said second end of said lever and said support and being operative to adjust a spacing between said second end of said lever and said support; and wherein operation of either of said actuators in either of said actuator assemblies serves to adjust an orientation of said load relative to said support.

10. A positioning device according to claim 9 wherein said load is an antenna element, and each of said actuators in each of said actuator assemblies comprises a linear drive element.

11. A positioning device according to claim 9 wherein said universal pivot rests on said support.

* * * * *